United States Patent [19]

Heidari

[11] Patent Number: 4,991,330

[45] Date of Patent: Feb. 12, 1991

[54] APPARATUS FOR MOUNTING PHOTOGRAPHS AND OTHER DOCUMENTS

[76] Inventor: Saeed M. Heidari, 27 Burgundy La., Middletown, Conn. 06457

[21] Appl. No.: 389,408

[22] Filed: Aug. 3, 1989

[51] Int. Cl.[5] ..... A47G 1/06

[52] U.S. Cl. ..... 40/158.1; 40/159.1

[58] Field of Search ..... 40/152, 156, 158.1, 40/159, 159.1, 159.2

[56] References Cited

U.S. PATENT DOCUMENTS

| | | | |
|---|---|---|---|
| 1,342,248 | 6/1920 | Bloomquist | 40/159.1 |
| 2,068,909 | 1/1937 | Engel | 40/159.1 |
| 2,816,381 | 12/1957 | Jablon | 40/152 |
| 3,491,471 | 1/1970 | Semple | 40/159 |
| 4,230,310 | 10/1980 | Henggeler-Achermann | 40/159.1 X |
| 4,452,666 | 6/1989 | Dorman | 40/159 X |
| 4,602,714 | 7/1986 | Ozeki | 40/159 |

FOREIGN PATENT DOCUMENTS

| | | | |
|---|---|---|---|
| 960080 | 4/1950 | France | 40/159.1 |
| 615244 | 1/1949 | United Kingdom | 40/152 |

*Primary Examiner*—James R. Brittain

*Attorney, Agent, or Firm*—Robert S. Smith

[57] ABSTRACT

Apparatus for mounting a photograph or the like which includes apparatus affixed to an associated mounting surface having linear parts thereof disposed in side abutting relationship to the sides of the associated photograph and a clear plastic member extending over the associated photograph and the apparatus for affixing constraining the associated photograph from movement on the associated mounting surface. Normally, the associated photograph is generally rectangular and the apparatus includes a plurality of generally planar members having an adhesive on front and back faces thereof. The planar members usually each have at least one rectilinear side disposed in side abutting relationship to at least one side of the associated photograph proximate to the respective corners thereof. The planar members may have a right angle recess therein which are each disposed in nested relationship to the respective corners of the associated photograph.

11 Claims, 2 Drawing Sheets

APPARATUS FOR MOUNTING PHOTOGRAPHS AND OTHER DOCUMENTS

BACKGROUND OF THE INVENTION

The invention relates to apparatus for mounting photographs and other documents and more particularly to such apparatus that will mount the photograph or other document without placing any adhesive on the photograph or other document. As used herein, the term "photograpgh" will be understood to refer to either a photograph or a documents such as a painting, diploma or the like. Such photographs are typically mounted on cardboard or pages of an album.

Photographs are commonly considered to be useful for recording important events of one's life. Accordingly, it is often desirable to save photographs in albums and like in which the photographs are fixed to various pages of the album. Conventional procedures include the use of cements which adheres the photograph directly to the page of the album. Such cements may, in some cases, affect the photographs due to passage through the surface of the photograph. In other cases, such adhesives will damage the photograph when the photograph is removed from the page of the album or even merely moved to a different location on the same page. This damage may occur because the photograph may rip as the photograph is removed.

The prior art includes various corner members having an adhesive which may be moistened for engagement with the page of an album. Such corner members typically have a slot therein into which the photograph is inserted. There are disadvantages to such corner members. Typically, the corner member is placed on the page first and then the photograph is inserted in the corner members. Accordingly, bending of the photograph may occur. If the corner members are first installed on the corners of the photograph and then the adhesive is moistened the procedure is cumbersome. In addition, the photograph cannot be easily moved because the corner members cannot be removed from the page without damaging the page.

The prior art also includes U.S. Pat. No. 4,230,310 which show corner members which grasp the corners of a building structural member. More particularly, the corner members described therein, have a right angle recess which nests with a structural member to hold that member. Such corner members have not been used on photographs to the best knowledge of the present inventor.

U.S. Pat. No. 4,125,653 teaches applying a transparent plastic film such as a non-adhesive coated film over the display article and taping the film and articles together around the edges.

U.S. Pat. No. 4,231,833 teaches the use of a transparent film such as a plastic sheet which has an adhesive layer thereon. The apparatus has a separate release sheet for uncovering the portion which is to go over a photograph or the like and a separate release paper which is disposed on a peripheral portion.

U.S. Pat. No. 4,145,830 describes the use of an adhesive on a skirt of an album leaf to retain a mat thereon. It is an object of the invention to provide apparatus which will avoid damaging the photograph and which will protect the photograph from damage.

It is another object of the invention to provide apparatus which will be facilitate easy movement of the photograph from one mounting position to another without any risk of damage to the photograph.

It is yet another object of the invention to provide apparatus which not place any adhesive on the photograph.

SUMMARY OF THE INVENTION

It has now been found that these and other objects of the invention may be attained in a apparatus for mounting a photograph or the like which includes means affixed to an associated mounting surface having linear parts thereof disposed in side abutting relationship to the sides of the associated photograph and a clear plastic member extending over the associated photograph and the means for affixing constraining the associated photograph from movement on the associated mounting surface.

This embodiment of the apparatus in accordance with the invention may cooperate with an associated photograph that is generally rectangular and the means for affixing includes a plurality of generally planar members having an adhesive on front and back faces thereof.

In this embodiment of the invention the planar members each have at least one rectilinear side disposed in side abutting relationship to at least one side of the associated photograph proximate to the respective corners thereof.

This embodiment may have planar members which have a right angle recess therein which are each disposed in nested relationship to the respective corners of the associated photograph.

The planar member may be generally circular, or generally L-shaped. The planar members may have a substantially centrally disposed bore therein and the central bore may communicate with the right angle cut-out.

In some embodiments the means includes four members disposed in linear abutting relationship to each of the sides of the associated photographs.

In some forms of the invention the means may include 4 generally rectangular members which are disposed in side abutting relationship to the respective 4 sides of the associated photograph near the center thereof.

In some forms of the invention the means includes 8 planar members which are each disposed in side abutting relationship to the associated photograph and 2 of the planar members are disposed proximate to each of the corners of the associated photograph.

BRIEF DESCRIPTION OF THE DRAWING

The invention will be better understood by reference to the accompanying drawing in which.

DESCRIPTION OF THE PREFERRED EMBODIMENTS

Figure 1:
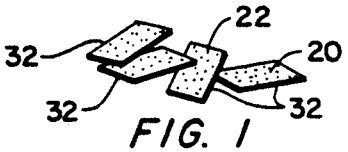
FIG. 1 is a perspective view of a plurality of rectangular adhesive elements in accordance with a first form of the invention.

Referring now to FIGS. 1–8 there is shown the apparatus in accordance with various forms of the invention. That apparatus constrains a photograph 10 mounted on a sheet 12 of an album. In a preferred form of the invention the photograph 10 is constrained by four corner members 14 which, in this preferred embodiment, are generally circular except for a right angle cut out 16 which is nested with the respective corners 18,18,18,18 of the photograph 10. The corner members 14 are generally planar and are provided with an adhesive on each planar face. More particularly, the corner members 14 would ordinarily have an adhesive 20 on the side thereof exposed to the mounting surface of album page 12 which would have a greater tackiness than the side thereof which is uppermost.

The uppermost face of the corner members 14 would ordinarily have an adhesive 22 which would have a lower tackiness than the lower most face of the corner members 14. A clear plastic member 26 is positioned on top of the corner members 14 to trap the photograph 10 against the album page 12 or other mounting surface. The difference in tackiness is particularly desirable to make it easy to move photographs from one position on the page to another. It will be seen that no adhesive 20,22 contacts the photograph 10 or other document that is being mounted so that there is very little risk of damage to the photograph 10.

Ideally, the album page 12 will be provided with a very light printed grid or matrix background to facilitate positioning of the photographs 10 in a neat arrangement.

Figure 5:
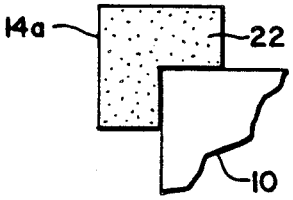
FIGS. 5,6,7, and 8 are plan views of alternative corner members that may be disposed at the corners of a photograph to constrain that photograph together with a transparent plastic overlay.
Figure 6:
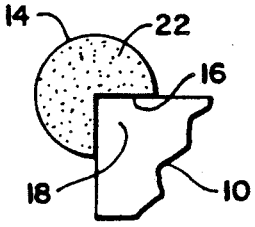
Figure 7:
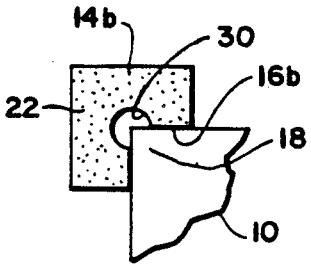
Figure 8:
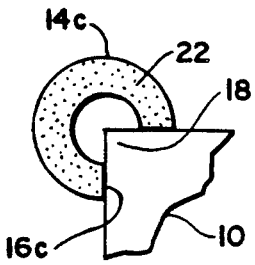

As shown in FIG. 5 and 7–8 the corner members may be various other shapes. For example, corner elements **14*a*, 14*b*, or 14*c* are respectively L-shaped, rectangular with a central hole 30 which communicates with a right angle cut-out 16*b* and ring shaped with a right angle cut-out 16*c*. The central opening in the elements 14*b* and 14*c* is advantageous because it simplifies alignment. Alternatively, the elements 14 and 14*a* provide greater contact with the photograph 10** and thus may grip the photograph more securely.

Figure 2:
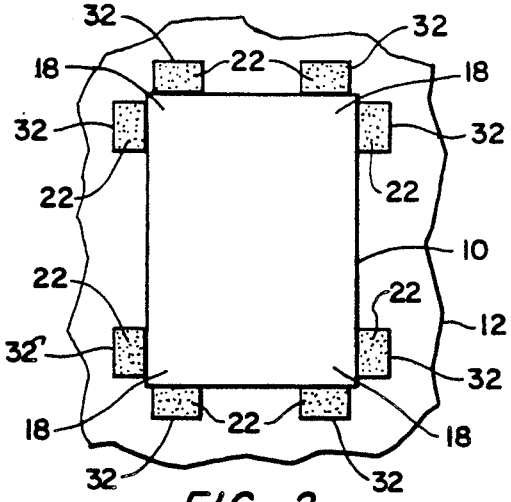
FIG. 2 is a fragmentary plan view of an album page having eight rectangular members arrayed in sets of two near the corners of a photograph for display.
Figure 3:
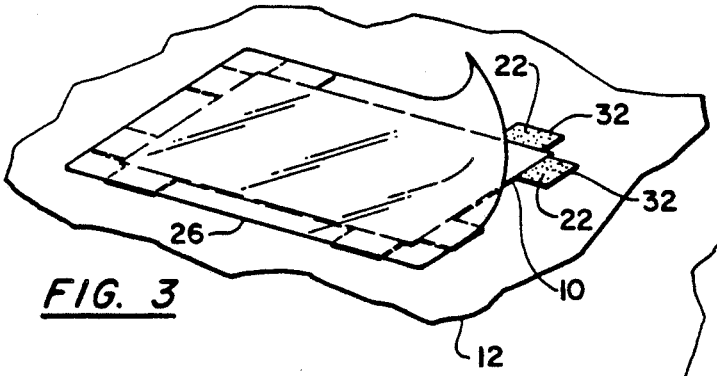
FIG. 3 is a view similar to that of FIG. 2 showing a clear plastic sheet being affixed to the rectangular members shown in FIG. 1 to constrain a photograph disposed on an album page.
Figure 4:
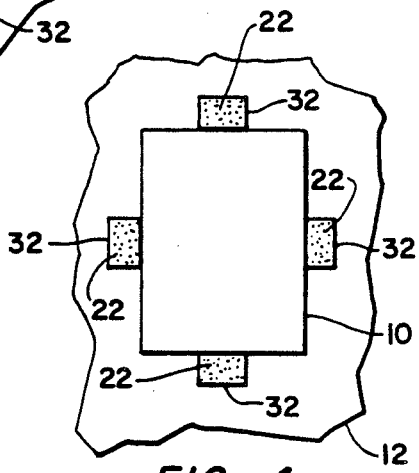
FIG. 4 is a view that is similar to FIG. 2 that illustrates an alternative arrangement of rectangular members such as those shown in FIG. 1.

In still another form of the invention, the photograph 10 may be constrained by 8 rectangular members as shown in FIGS. 2 and 3. In this embodiment, 2 rectangular members are disposed in side abutting relationship near each of the corners 18,18, 18,18. A clear plastic member 26 extends over the rectangular members 32 and engages the upper face and particularly the adhesive 22 of the rectangular members 32 to constrain the photograph 10 by cooperation with the rectangular members 32.

It will be understood that the members 32 preferably have at least one rectilinear side that abuts the photograph 10 to provide maximum positioning forces. Those skilled in the art will recognize that, for example, the members 32 may be generally round, polygonal, square or even some random shape as long as there is at least one rectilinear side that is positioned in side abutting relationship to the photograph.

Figure 9:
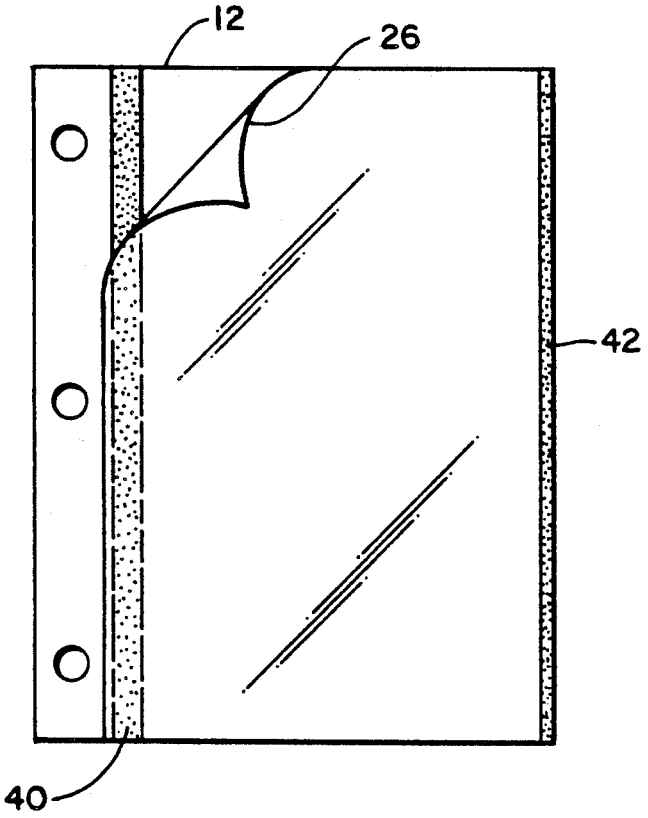
FIG. 9 is a plan view of a page of an album in accordance with the invention having a clear plastic overlay extending over the entire page for engagement with the adhesive members in accordance with the invention.

As shown in FIG. 9 the clear plastic overlay 26 is preferably dimensioned to overlay the entire page 12 of the album. The overlay 26 may be provided with an adhesive 40,42 for securing the left and right edges thereof to the page 12. In other forms of the invention adhesive strips such as 40,42 extend along the top and bottom edges of the overlay 26 to secure those edges. It will be understood that the members **32. 14*a*, 14*b*, 14*c* and 14*d* also engage the overlay 26 to further secure the overlay as well as the photograph 10. In some embodiments the adhesive 42 may be disposed on the back of the page 12 and the overlay 26 may be folded around the right edge of the page 12. In various other embodiments the overlay 26 may be bonded, or otherwise secured to the page 12, and then folded around the right edge of the page 12**.

In some forms of the invention the members such as **14*a*–14*c* and 32** may themselves be manufactured of clear plastic material.

It will thus be seen that the apparatus in accordance with the invention securely mounts that photograph to an album page and the like without applying any adhesive directly to the photograph while still allowing easy movement of the photographs from one position to another or mounting different size photographs on the same album page.

The invention has been described with reference to its illustrated preferred embodiment. Persons skilled in the art of such devices may upon exposure to the teachings herein, conceive other variation. Such variations are deemed to be encompassed by the disclosure, the invention being delimited only by the appended claims.

Having thus described my invention I claim:

1. Apparatus for mounting an associated photograph on an associated mounting surface and to constrain movement of the associated photograph on the associated mounting surface so that the associated photograph is prevented from any substantial movement which comprises:

first means for affixing the associated photograph on the associated mounting surface comprising an element which is generally planar and has adhesive on the planar surfaces thereof, said first means having a generally rectilinear side thereof disposed in side abutting relationship with a small portion of one or more sides of the associated photograph;

second means for affixing the associated photograph on the associated mounting surface comprising an element which is generally planar and has adhesive on the planar surfaces thereof, said second means having a generally rectilinear side thereof disposed in side abutting relationship with a small portion of one or more sides of the associated photograph;

third means for affixing the associated photograph on the associated mounting surface comprising an element which is generally planar and has adhesive on the planar surfaces thereof, said third means having a generally rectilinear side thereof disposed in the side abutting relationship with a small portion of one or more sides of the associated photograph;

fourth means for affixing the associated photograph on the associated mounting surface comprising an element which is generally planar and has adhesive on the planar surfaces thereof, said fourth means having a generally rectilinear side thereof disposed in side abutting relationship with a small portion of one or more sides of the associated photograph; and a clear plastic member extending over the associated photograph and said first, second, third and fourth means for affixing with the adhesive on one planar face thereof engaging said clear plastic member and the adhesive on the other planar face thereof engaging the associated mounting surface wherein there are substantial gaps between said first, second, third and fourth means to that each of said means does not contact any other of said means.

2. The apparatus as described in claim 1 wherein:

the associated photograph has four corners; and said elements each have said one rectilinear side disposed in side abutting relationship to at least one side of the associated photograph proximate to the respective corners thereof.

3. The apparatus described in claim 1 wherein:

said elements each have a right angle recess therein which are each disposed in nested relationship to the respective corners of the associated photograph.

4. The apparatus as described in claim 3 wherein:

each of said elements is generally circular.

5. The apparatus as described in claim 4 wherein:

each of said elements is generally L-shaped.

6. The apparatus as described in claim 5 wherein:

each of said elements have a substantially centrally disposed bore therein.

7. The apparatus as described in claim 6 wherein:

said central bore communicates with said right angle recess.

8. The apparatus as described in claim 1 wherein:

said elements are disposed in rectilinear abutting relationship to each of said sides of the associated photographs.

9. The apparatus as described in claim 8 wherein:

said elements are each generally rectangular members which are disposed in side abutting relationship to the respective four sides of the associated photograph near the center of the respective sides thereof.

10. The apparatus as described in claim 9 wherein:

each of said means further includes a second planar member having adhesive on the respective planar faces thereof, each of said elements being disposed in side abutting relationship to the associated photograph and two of said planar members are disposed proximate to each of the corners of the associated photograph.

11. The apparatus as described in claim 10 wherein:

said clear plastic member extends over a major extent of said mounting surface.

* * * * *